United States Patent [19]

Bogdanski

[11] 3,981,270

[45] Sept. 21, 1976

[54] ENDLESS BELT ENVELOPE FLAP MOISTENING SYSTEM

[75] Inventor: John J. Bogdanski, Stamford, Conn.

[73] Assignee: Pitney-Bowes, Inc., Stamford, Conn.

[22] Filed: Mar. 10, 1975

[21] Appl. No.: 556,680

[52] U.S. Cl. ..... 118/257; 156/442.2

[51] Int. Cl.[2] ..... B05C 1/14

[58] Field of Search ..... 118/32, 257, 258, 259; 156/441.5, 442.1, 442.2; 53/383

[56] References Cited

UNITED STATES PATENTS

| | | | |
|---|---|---|---|
| 829,030 | 8/1906 | Nachod | 156/442.1 |
| 1,528,935 | 3/1925 | MacDonald | 118/257 X |
| 3,811,407 | 5/1974 | Lupkas et al. | 118/32 |

*Primary Examiner*—John P. McIntosh
*Attorney, Agent, or Firm*—Robert E. Meyer; William D. Soltow, Jr.; Albert W. Scribner

[57] ABSTRACT

A moistening system for moistening the gummed flaps of envelopes being processed in a postage meter mailing machine includes a rotating endless belt extending into a liquid supply and transferring moisture to flaps pressed against it by a contoured finger positioned adjacent to the belt. The finger is curvedly bowed and twisted relative to the belt moistening surface so as to urge essentially only the gummed portion of the flap against the belt for moistening although a wide variety of envelope flap designs and sizes are processed. The endless belt may be pivotably supported to permit convenient removal of the liquid supply container. The container is part of a liquid reservoir assembly which includes a tray support for the container which requires that several motions, vertical and horizontal, be sequentially followed before the container may be removed from the machine. This minimizes inadvertent spillage. The container may have cam surfaces cooperating with complementary parts of the endless belt device to pivot it. Interlocks to prevent operation of the belt when the container is not in place are provided. The entire system is conveniently positioned below the deck of and within the postage meter mailing machine.

9 Claims, 12 Drawing Figures

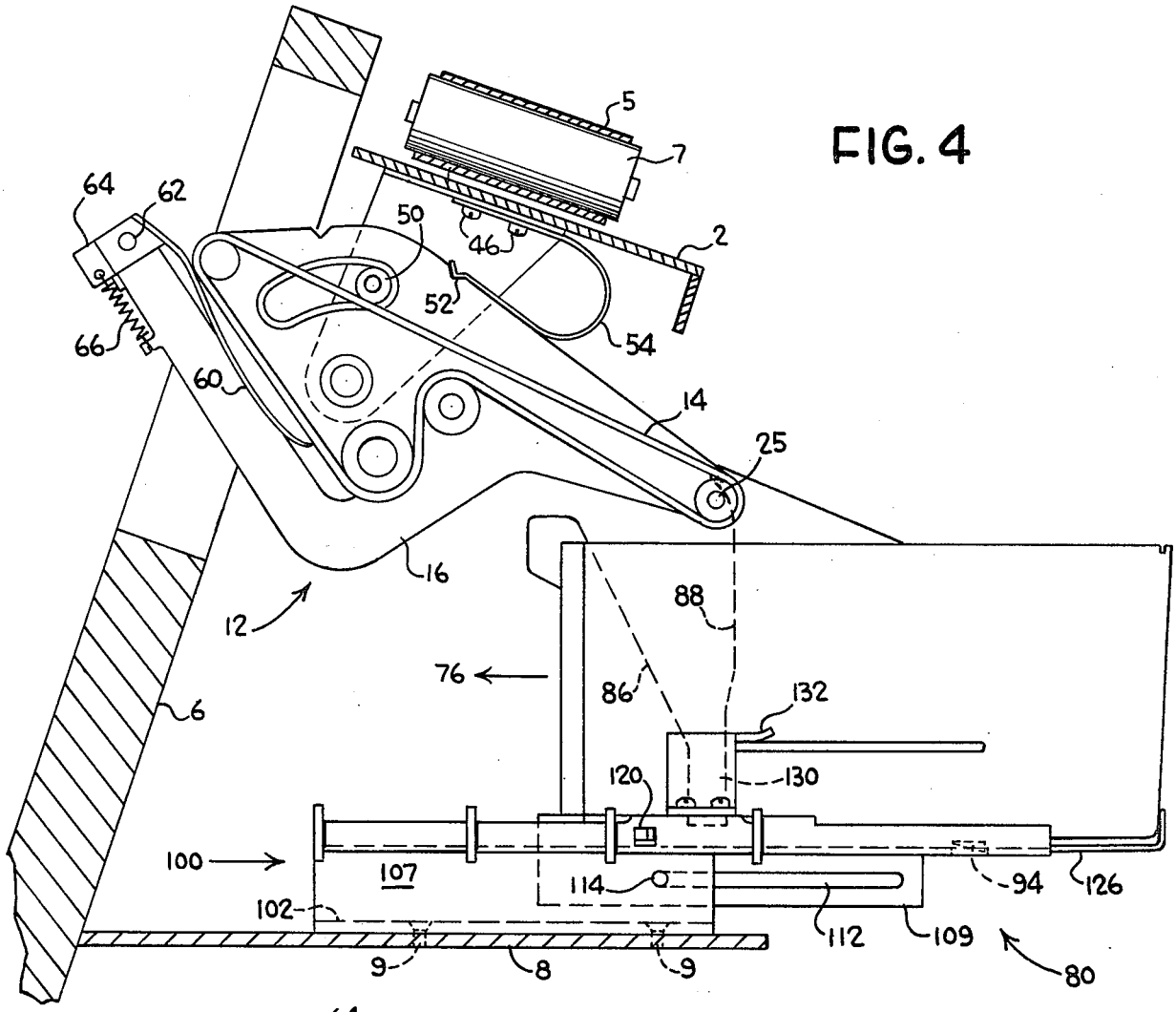
FIG. 4
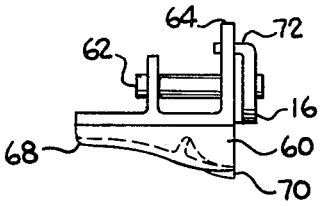
FIG. 9
FIG. 11
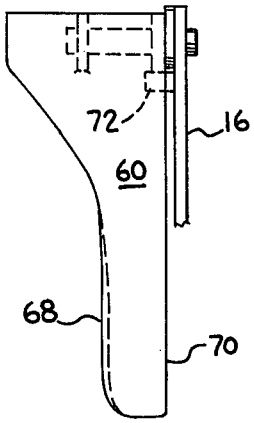
FIG. 10
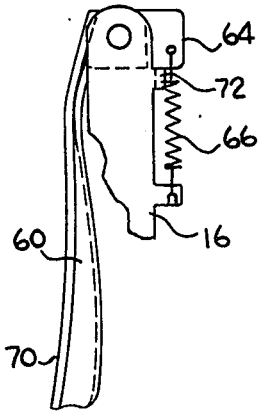

ENDLESS BELT ENVELOPE FLAP MOISTENING SYSTEM

BACKGROUND OF THE INVENTION

This invention relates to a system for moistening the gummed closure flaps of envelopes, and more particularly to a moistening device and associated liquid reservoir assembly for use in machines which process envelopes such as postage meter mailing machines.

Postage meter mailing machines generally have associated therewith devices to apply moisture to the gummed flap of an envelope and seal the envelope as operations ancillary to the application of postage thereto. Several systems for moistening envelope flaps have been utilized. U.S. Pat. Nos. 2,167,252 and 2,167,257 disclose moistening blades are generally machined from bronze stock and are costly to fabricate within the tolerances required. Moreover, the liquid reservoirs associated with such devices require careful handling for priming the blades and to avoid spilling when removing the reservoirs from the machine for refilling.

Another system for moistening envelope flaps, disclosed in U.S. Pat. No. 3,811,407, utilizes a wick positioned in a moisture applying means extending into a water reservoir. The moisture applying means is positioned below the deck of an envelope processing machine. The main body of an envelope travels on the deck as the flap travels below the deck. A spring like member forces the flap of the envelope to pass between it and the wick into firm contact with the wick so that wiping action of the gummed region of the flap against the wick is produced. In such a system the wick is essentially stationary and transfer of moisture is accomplished through capillary action of the hydrophilic synthetic resilient open cell foam material forming the wick.

Postage metering operations have become both high speed and relatively trouble free. Consequently, an operation ancillary to postage metering, such as envelope flap moistening, must be similarly high speed and reliable. Thus, although the moistening systems heretofor utilized have functioned with varying degrees of success it is nevertheless desirable to provide moistening systems which are reliable and high speed, as the postage metering operation, while at the same time being economical to produce and to maintain substantially problem free.

SUMMARY OF THE INVENTION

The present invention provides a moistening system including an envelope flap moistening device capable of high speed moistening of a large variety of envelope types and sizes. In addition, the moistening device transfers moisture essentially only to the gummed portion of the envelope flap. A liquid reservoir assembly associated with the moistening device provides a water supply container and tray support means enabling removal of the container from the envelope processing machine which avoids spillage of water and does not necessitate removal of the system parts. The moistening system is positioned below the deck of a postage meter mailing machine or other envelope handling machine.

The foregoing and other advantages are obtained according to this invention by providing a moistening device including a driven endless belt of fabric capable of transferring liquid such as water from a container to the gummed flap of an envelope passing in proximity to the belt. A spring loaded, contoured finger applies slight pressure to the envelope flap as it passes by the belt so as to press only the gummed portion of the envelope flap against the belt for moistening. The endless belt is supported on a pivotably mounted support means and extends downward into the container when in operative position. The support means may be pivoted up out of the container when the container is withdrawn from the envelope handling machine for refilling.

The container is removably mounted in a drawer-like slidable tray for access for removal for refilling and includes internal cam surfaces which cooperate with the endless belt support means to pivot the support means into downward or upward position depending on whether the container is in the machine or in withdrawn position. The container and tray include cooperating guide elements which assure that the container cannot be removed unless there is effected a first horizontal withdrawal motion followed by vertical lift motion and a second horizontal and vertical motion to free the container. Such a series of movements assures that the water in the container is not spilled by too sudden a removal. In addition, the container tray is maintained in an open position and cannot be closed except with the presence of the container therein, thus avoiding inadvertent operation of the moistening device without the presence of liquid.

The moistening system is positioned below the deck of an envelope processing apparatus such as is used in a heavy duty envelope moistener and sealer and postage meter machine. Generally, the main body of the envelope travels on the upper surface of the deck as the flap travels below the deck. Thus, as the gummed envelope flap passes the moving endless belt the contoured finger applies slight pressure thereto to produce a wiping action of the gummed portion only against the belt and a resultant transfer of moisture thereto.

Thus, it is a feature of this invention to provide an envelope flap moistening system capable of high moistening capacity, comparatively trouble free operation and ease of maintenance.

A further feature of this invention is the provision of a moistening device capable of moistening only the gummed portion of an envelope flap.

Another feature of this invention is the provision of a liquid reservoir assembly for a moistening system which permits access to and removal of a liquid container for cleaning and refilling while assuring the absence of spillage and the prevention of operation of the moistening system without the container being in operative position.

The present invention provides a moistening device capable of handling a wide range of envelope flap types, shapes and sizes with less drag and with a reduction in the possibility of jamming. The endless belt moistening means provides a reduction of wear and a minimization of maintenance requirements. By moistening essentially only the gummed region of the flap, wetting of the envelope contents is desirably avoided since if the entire surface of the flap was moistened, the subsequent closing of the flap would bring the upper moistened portion of the flap into contact with the contents of the envelope. The system of the present invention is self-priming, utilizes a moistening material which is easy to replace and provides ease of filling of a liquid container without concern for spillage or inadvertent operation while the container is out of the envelope processing machine.

BRIEF DESCRIPTION OF THE DRAWINGS

The foregoing features, objects and advantages of the invention will become more apparent and the invention will be more fully understood from the following description taken in conjunction with the drawings, wherein:

FIG. 4 is a view similar to that of FIG. 2 but showing the liquid container in the process of being inserted in the system with the moistening device contacting the container cam surface for pivotal movement downward;

FIG. 9 is a top view of the pressure applying contoured finger according to this invention;

FIG. 10 is a front view of the pressure applying contoured finger; and

FIG. 11 is a side view, looking upstream, of the pressure applying contoured finger.

DESCRIPTION OF THE PREFERRED EMBODIMENTS

Figure 1:
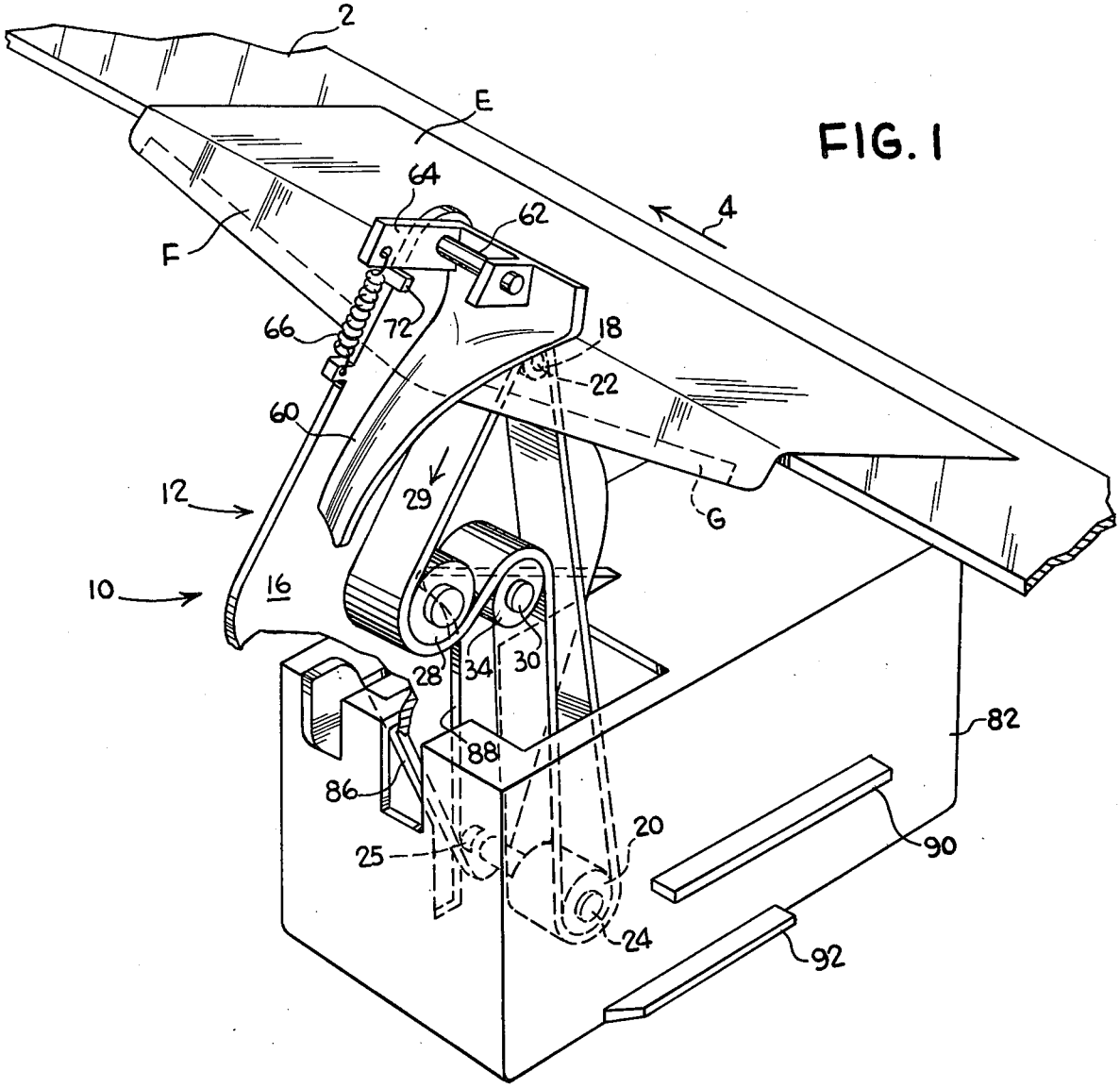
FIG. 1 is a perspective top rear view of a moistening system embodying the features of the present invention.

FIG. 1 shows a perspective view of an envelope flap moistening system 10 which may be employed with most types of postage meter mailing machines as well as other types of envelope handling and processing apparatus. For clarity of illustration, only a deck 2 of such a mailing machine or envelope handling system is shown together with an envelope E traveling thereon. Generally, envelopes such as E are carried through a postage meter mailing machine in the direction indicated by the arrow 4 so that envelopes travel in succession, on the deck 2, from a region in which the envelopes are stacked, past the envelope moistening system 10, through a sealing region, not illustrated but of the known type, and thence to the postage meter section of the machine where postage is applied to the envelope.

The view illustrated in FIG. 1 is taken looking at the rear of the postage meter mailing or envelope processing machine. The body of the envelope E travels along the upper surface of the deck 2 while the envelope flap F hangs over the rear edge of the deck so that the gummed portion G of the flap is beneath the surface of the deck as it passes through the moistening region. In the embodiment shown in FIG. 1, the deck 2 extends at an angle with respect to a horizontal plane and although this may provide some benefit for efficient moistening, as will be explained hereinafter, it is unnecessary to the invention so that the deck may be horizontal if desired.

Figure 2:
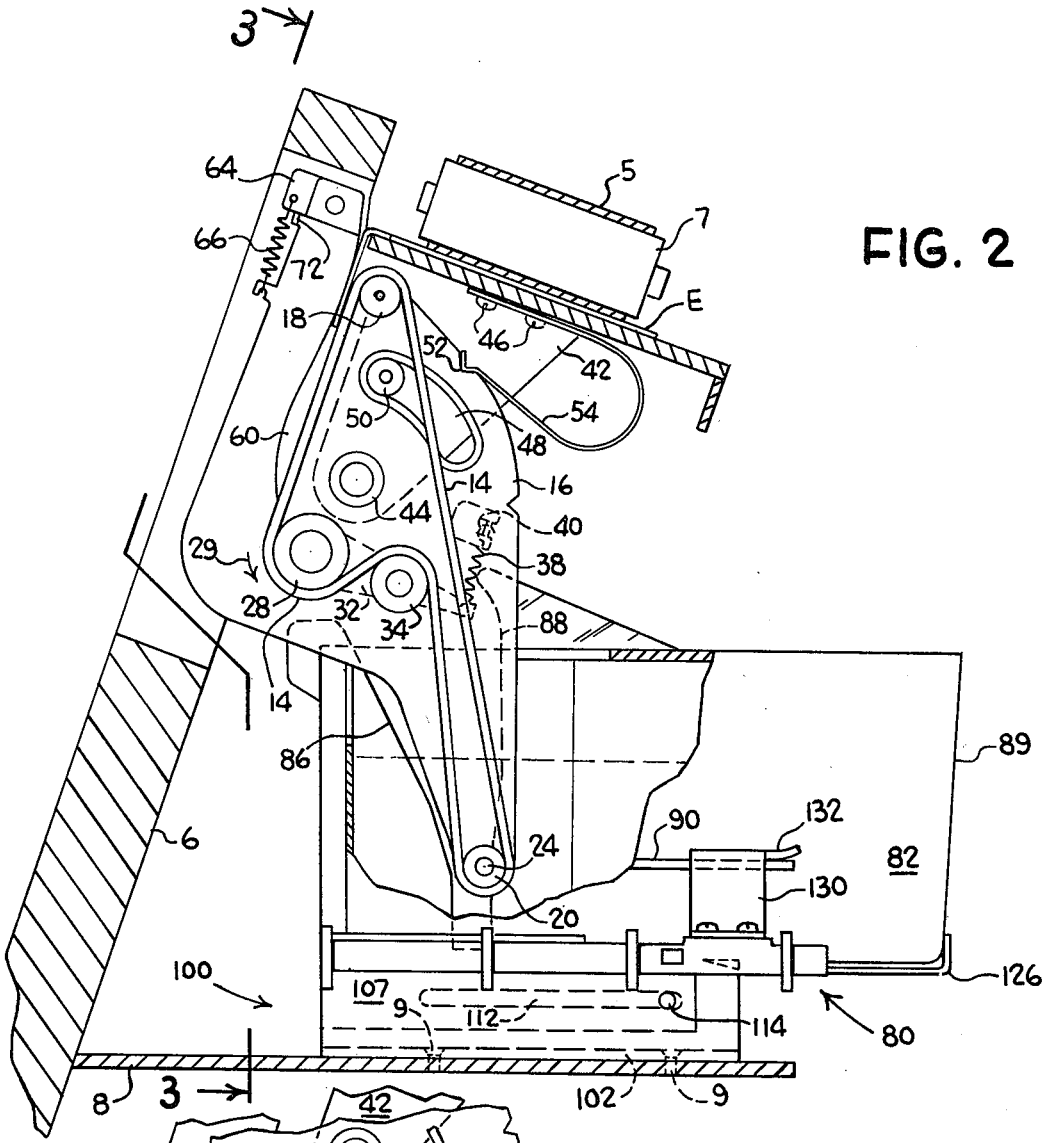
FIG. 2 is a side elevational view, partly in section, of a moistening system in accordance with the present invention.
Figure 5:
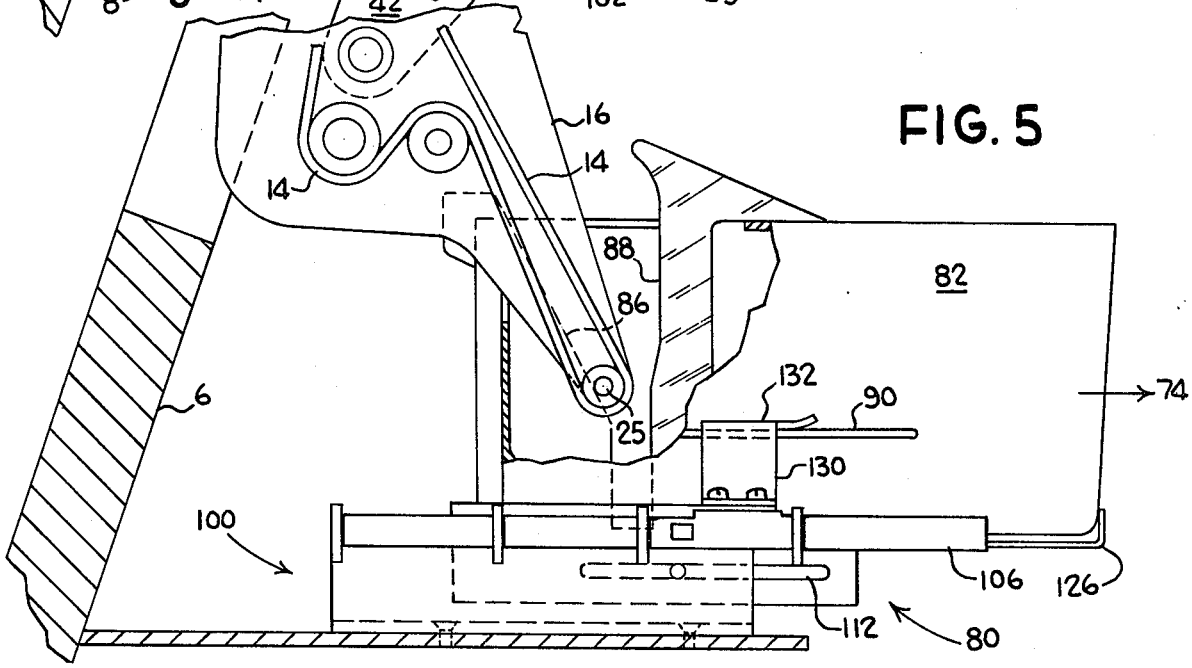
FIG. 5 is a view similar to that of FIG. 4 but showing the liquid container in the process of being removed from the system with the moistening device contacting the container cam surface for pivotal movement upward.
Figure 6A:
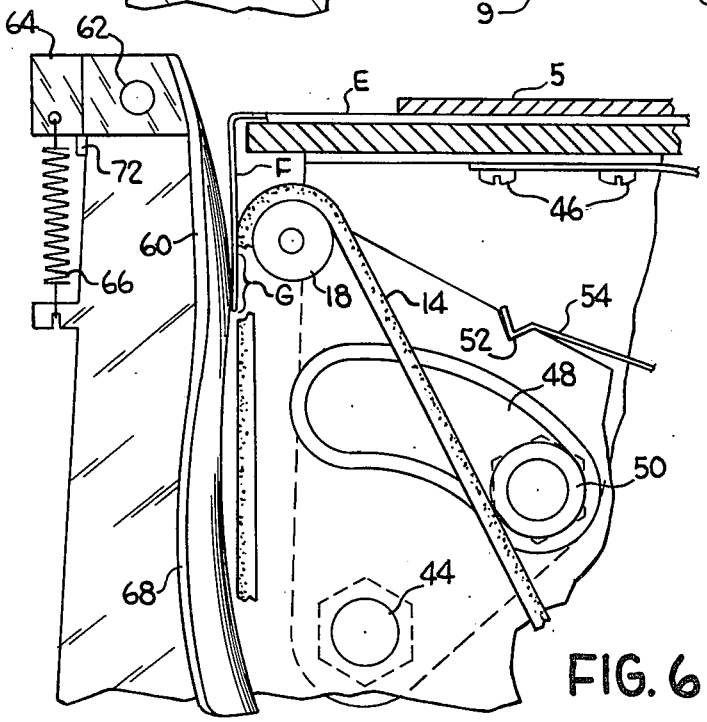
FIGS. 6 and 6A are enlarged fragmentary views within the moistening device taken along line 6—6 of FIG. 3 looking downstream and showing the envelopes with two different flap sizes, respectively, being moistened in their gummed regions only by the device.
Figure 6:
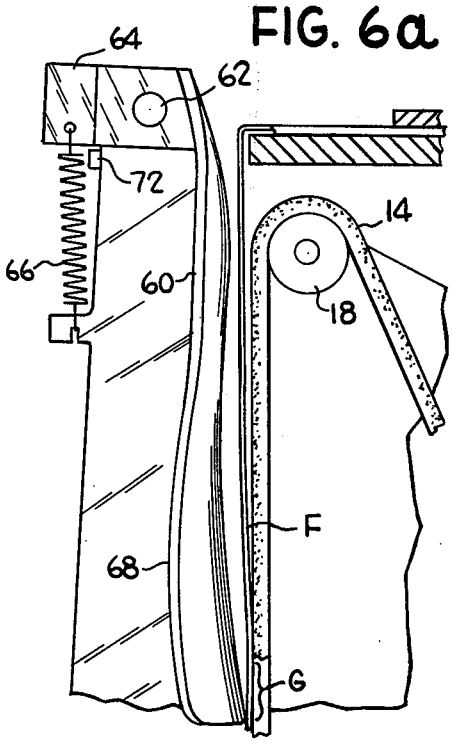

The envelope flap moistening system 10 includes a liquid reservoir assembly 80 seen in its entirety in FIGS. 2, 4 and 5, having a container or tank 82 for holding water or other liquid for moistening of the flaps. The container 82 is operatively associated with a moistening device 12 comprising an endless belt of fabric 14 with support and drive pulley means, to be described in greater detail hereinafter, for continuously driving the belt to pick up water from the container 82 and transport it to the gummed region of a flap F as the flap passes by, and in contact with, the belt 14. The moistening device includes a contoured finger 60 supported in proximity to the endless belt 14 and of such a design and shape so that the gummed region, illustrated at G, of a flap F is pressed against the moisture applying endless belt 14 with a force sufficient to apply adequate moisture for moistening the flap irrespective of whether the envelope is of the thin and/or light weight, airmail type, or of the heavy and/or thick Kraft paper type. In addition, the contoured finger 60 has a bowed configuration, seen best in FIGS. 9 through 11, which results in pressure being applied to the envelope flap F, as it passes between the finger 60 and the endless belt 14, so that the envelope flap does not contact the belt, as seen in FIGS. 6 and 6A, except essentially only in the gummed portion of the flap.

Figure 3:
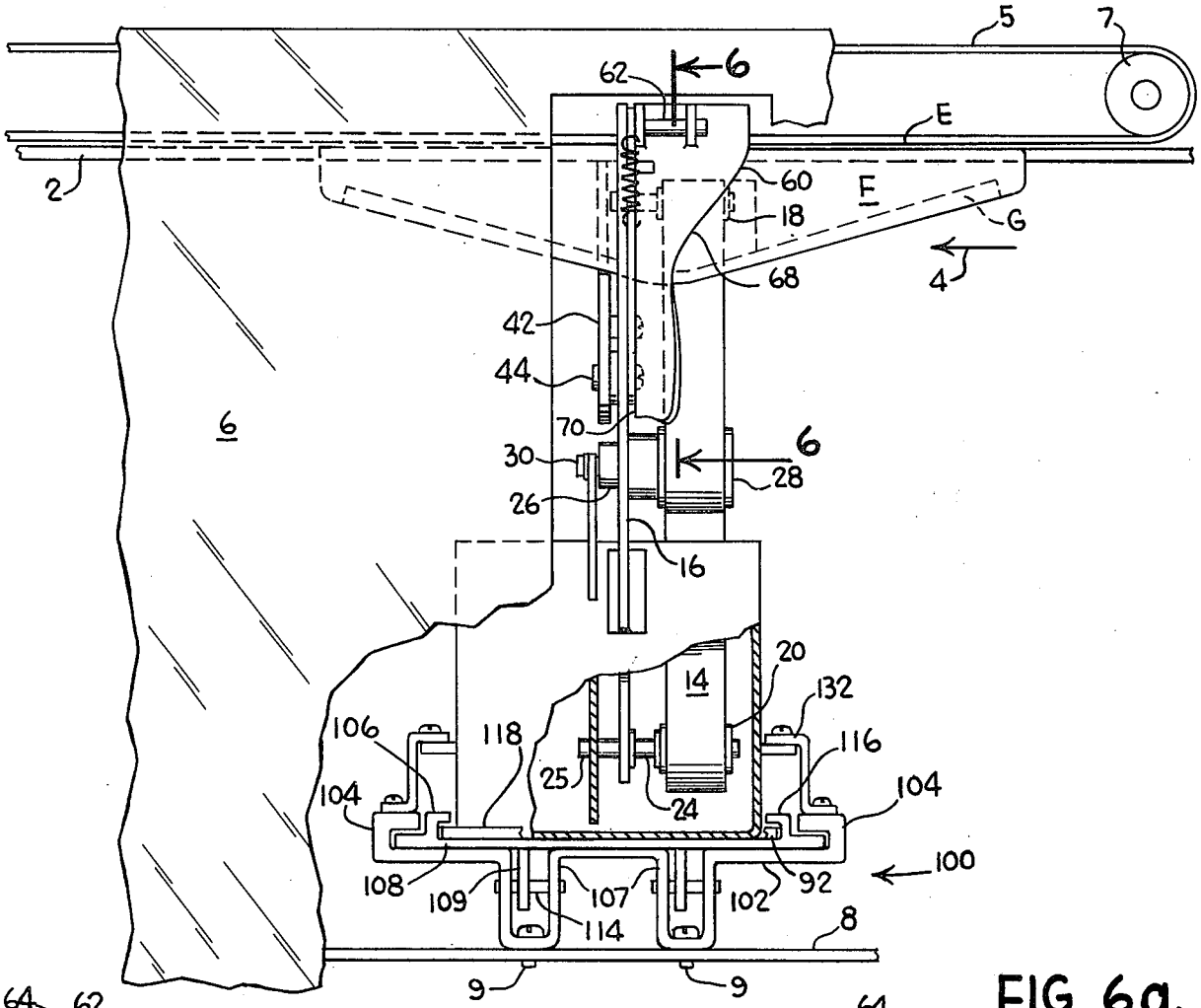
FIG. 3 is a rear elevational view, partly in section, of the moistening system of FIG. 2 taken along the line 3—3 of FIG. 2.

The components of the envelope flap moistening device 12 are best seen in detail in FIGS. 1, 2 and 3. FIGS. 2 and 3 show the postage handling machine rear and bottom members 6 and 8 which support the deck 2 and hence the moistening device 12 and liquid reservoir assembly 80 respectively. Also illustrated in FIGS. 2 and 3 is the drive belt 5 which is driven by roller 7 and which propels the envelope E along the deck 2 in the direction of the arrow 4, shown in FIGS. 1 and 3.

The endless belt 14 is supported on freely turning support pulleys or rollers 18 and 20 which are supported for free rotation on spindles 22 and 24 respectively. The spindles 22 and 24 are fixed to a support plate 16 which also carries a drive pulley 28 for driving the endless belt 14 in the direction indicated by arrow 29. The drive pulley 28 is fixed to a shaft 30 rotating in a bushing 26 fixed to the support plate 16 and may receive power input from a flexible shaft means, not shown. An arm 32 is pivoted about the shaft 30 and carries, at its opposite end, a tension pulley or roller 34 over which passes the endless belt 14. The tension pulley 34 rotates freely on a spindle 36 fixed to the arm 32. The arm 32, and thus the tension pulley 34, is maintained in tension against the belt 14 by means of a spring 38 secured to the end of the arm 32 and to a hook 40 carried on the support plate 16.

The support plate 16 is pivotally secured to a bracket 42 by means of a pivot bolt 44. The bracket 42 is secured to the deck 2 by means of bolts 46. The bracket 42 contains an opening 48 which functions as a track in which travels a pin 50 secured to the plate 16. The track 48 and the pin 50 assure that pivotal movement of the plate 16 is limited. The plate 16 also contains a notch, shown at 52, into which detents a bent spring means 54 carried by the bracket 42 to assure that the support plate 16 and thus the entire moistening device 12 is maintained in one of two positions, as will be explained hereinafter.

The endless belt 14 may be fabricated of any suitable material capable of picking up and transferring liquid. Synthetic napped materials, such as those identified under the tradenames Dynel and Nylon, of the type used in paint rollers have been found to be satisfactory. The speed of revolution and the width of the endless belt 14 must be such that sufficient liquid, such as water, is transferred from the container or tank 82 to the gummed region G of the envelope flap F to moisten it sufficiently for proper sealing. The speed of the belt is controlled by the flexible power shaft input and this may be coordinated, by known means, with the speed of the postage meter mailing or envelope processing machine so as to adequately moisten the envelopes being processed. As shown in FIG. 2, the endless belt 14 is maintained under an appropriate degree of tension by the tension pulley 34 which also facilitates removal of the belt from the moistening device merely by relieving tension through movement of the arm 32 and the tension pulley 34. Thus, the belt 14 may be readily replaced in the event that it becomes worn or otherwise needs replacement.

As seen in FIGS. 1–3, a contoured finger 60 is operatively associated with the endless belt 14 to urge the gummed portion G of the envelope flap F against the belt 14 for moistening. The contoured finger 60 is pivotally mounted on a spindle 62 which is secured to the support plate 16 which carries the spindles and pulleys supporting the belt 14. The upper end of the contoured finger 60 has a cantilevered arm 64 by which a spring 66 connects the finger 60 to the support plate 16 in order to maintain the contoured finger under slight pressure as envelopes pass between it and the endless belt 14.

The contoured finger 60 is shown in FIGS. 9 through 11 where it is seen to have a complex concaved curved surface beginning at its leading upstream edge 68 and which, as shown in FIGS. 9 and 11, is both bowed and twisted in relationship to a plane taken through the longitudinal axis of the finger and parallel to the spindle 62. The contour of the finger 16 is best understood by further reference to FIGS. 3, 6 and 6A showing the finger in operative relationship with the endless belt 14.

Referring to FIG. 3 is can be seen that the upper portion of the leading or upstream edge 68 of the finger 60 extends to a position upstream of the upstream edge of the endless belt 14 and then curves progressively downward so that the lower portion of the leading edge 68 is positioned at a location parallel to or just immediately upstream of the trailing or downstream edge of the belt 14. The essentially vertical downstream edge 70 of the contoured finger 60 is located downstream of the belt 14. When no flap is between the finger and belt, the finger is tensioned so that the leading edge 68 and the trailing edge 70, relative to a plane through the vertical portion of the belt 14, are behind the plane, that is, to the rear of the machine, and in front of the plane, respectively. A stop 72 against which the arm 64 of finger 60 rests limits the movement of the finger 60 towards the belt 14 and helps assure this positioning.

This positioning of the finger 60 as well as its bowed and twisted contour assures that pressure is applied against the envelope flap F as it passes between the finger 60 and the belt 14 in such a manner so that only the gummed region G of the flap comes into contact with the belt 14 for moisture application and the entire flap is not moistened. This is illustrated in FIGS. 6 and 6A for two different flap sizes. Referring first to FIG. 6, it can be seen that envelope E with flap F is passing along the deck 2 so that the flap F is between the finger 60 and the belt 14. The gummed region of the flap F, indicated by the letter G, generally constitutes the edge position of the flap. In FIG. 6 it can be seen that the flap is of a short size and yet the gummed region G is in contact with the belt 14 for moisture pickup. Referring to FIG. 6A, there is shown a flap of considerably larger size also with a gummed region G. The gummed region G is maintained in contact with the belt 14 for moisture transfer while the rest of the flap is slightly bowed out by the action of the finger 60 against the envelope flap F and the belt 14 so that the entire flap is not in contact with the belt and does not pick up the moisture.

In operation, envelope E travels along the deck 2 by being propelled by the drive belt 5. As it passes into the moistening station, the envelope flap F traveling over the edge of the deck 2 is guided in front of the endless belt 14. The finger 60 applies pressure against the flap F so that it contacts the endless belt 14. Due to the contoured shape of the finger 60 and its position relative to the endless belt 14 so that its leading edge 68 is for the most part either aligned with the trailing edge of the belt 14 or in a position just in front thereof, only the gummed region G of the envelope flap F is moistened. This occurs since pressure is applied by the finger 60 only against the gummed region G to contact the belt 14 while the rest of the flap is maintained out of contact therewith. In this way, wetting of the entire flap is avoided so that contents of the envelope are not wetted.

Due to the shape and positioning of the finger and endless belt a wide variety of envelopes may be handled. The embodiment of the finger illustrated is able to handle different sizes and shapes of envelopes, having flap sizes from one to four inches deep. These flaps may be square, rounded or pointed as is known in the art. Envelopes as varied as 5 inch long onion skin envelopes to 15 inch long Kraft envelopes having four inch deep flaps have been moistened successfully to advantage herein. It will be understood that those skilled in this art, given this specification, will be able to adjust the contour and positioning of the finger to handle other envelope sizes and shapes, if desired. Similarly, the finger may be fabricated from bronze, stainless steel or, advantageously, plastic provided only that the surface be smooth to avoid catching the flap.

The moistening device here illustrated moistens the envelope flaps with less drag than those currently used. In addition, problems of jamming are minimized. The endless belt 14 by constantly rotating through the liquid container does not become gummed up or create dust as in other devices. Moreover, the passage of the rotating belt through the liquid container stirs the water and provides self priming.

Since the finger 60 contacts only the lower portion of the flap and applies pressure thereto the upper portion is maintained free and actually bows slightly to avoid contact with the belt 14. The spring loading of the finger by spring 66 is sufficient to insure adequate contact for moistening. In addition, the deck 2 may be tilted relative to the horizontal, a tilt of approximately 20° is illustrated, and this will provide the further advantage of utilizing gravitational force against the flap F to enable it to contact the belt 14. However, this is not necessary for successful operation of the device.

The removal of the liquid container 82, into which the endless belt 14 extends for picking up liquid for transfer to the envelope flap gummed region, is facilitated by the fact that the support plate 16 carrying the endless belt 14 and contoured finger 60 is pivotally mounted on the bracket 42 secured to the deck 2 of the mailing machine. FIG. 2 shows the moistening device 12 in its operative position with the container 82 secured in place within the mailing machine. When it is desired to remove the container, the container 62 is merely withdrawn from the machine in the direction of the arrow 74, as illustrated in FIG. 5. As a consequence of this movement the support plate 16 is pivotally moved due to the action of the cam surface, to be explained in greater detail hereinafter, on the cam follower 25 which is an extension of the spindle 24 of the support pulley 20, as best seen in FIG. 1. Thus, upon removal of the container 82 the entire support plate 16 for carrying the endless belt 14 and the contoured finger 60 is pivoted up and out of place. Upon replacement of the container 82 and insertion in the machine in the direction of the arrow 76, as illustrated in FIG. 4, the cam follower 25 contacts another cam surface for pivotal movement back into place for operation. These will be described in greater detail hereinafter in reference to the liquid reservoir assembly.

The entire liquid reservoir assembly 80 is shown operatively in FIGS. 2, 4, and 5. Referring to FIG. 2, it can be seen that the liquid reservoir assembly 80 includes a liquid container or tank 82 and a guide assembly indicated generally at 100. The container 82, shown also in FIG. 1, includes an opening 84 into which the endless belt 14, and support plate 16 project so that the endless belt 14 is located below the surface of liquid, such as water, therein. Located within the container 82 are "withdrawal" and "insertion" cam surfaces 86 and 88 respectively. Cam surface 86, as seen in FIGS. 1, 4 and 5, occupies the rear portion of the container 82 and is so configurated, with a vertical edge surface joining an edge surface inclined to the vertical, progressing toward the rear of the container and machine, that the cam follower 25 moves along the surface 86 as the container 82 is withdrawn from the postage meter mailing machine.

This movement of the cam follower 25 causes the support plate 16 to pivot upwardly on the bracket 42 and place the endless belt out of the container 82 so that the container may be removed for refilling and/or cleaning. The second cam surface 88 within the container 82 is spaced from the cam surface 86 so that upon repositioning of the container 82 in the postage meter mailing machine the cam follower 25 contacts the edge surface of the cam surface 88 to pivot the support plate 16 downwardly thus placing the endless belt 14 into the container in operative position.

The container 82, as well as the cam surfaces 86 and 88 therein, may be fabricated from high impact plastic material such as polycarbonate and the like. The endless belt driving means can be provided with an electrical interlock which functions upon pivoting of the support plate 16 to shut off the power input drive and prevent operation of the endless belt 14 and/or the entire machine when the belt 14 is not correctly positioned within the container 82. The upstanding internal cam surfaces 86 and 88 have been described generally and are operative as shown, it being understood, however, that those skilled in the art may provide other cam means associated with the container 82 to accomplish the function here taught. The container 82 may also contain internal baffle means to avoid extensive movement of water therein and thus minimize the risk of spillage in transporting the container after having been refilled. The container 82 may also be provided with a clear plastic front or one molded to provide a prism effect, as shown at 89 in FIG. 8, so that the water level therein may be observed.

The liquid reservoir assembly 80 includes structural features which assure that the container may be removed from the postage meter mailing machine and refilled with a minimum of spillage and with assurance that the moistening device will not function unless the container is in proper position in the machine.

Figure 7:
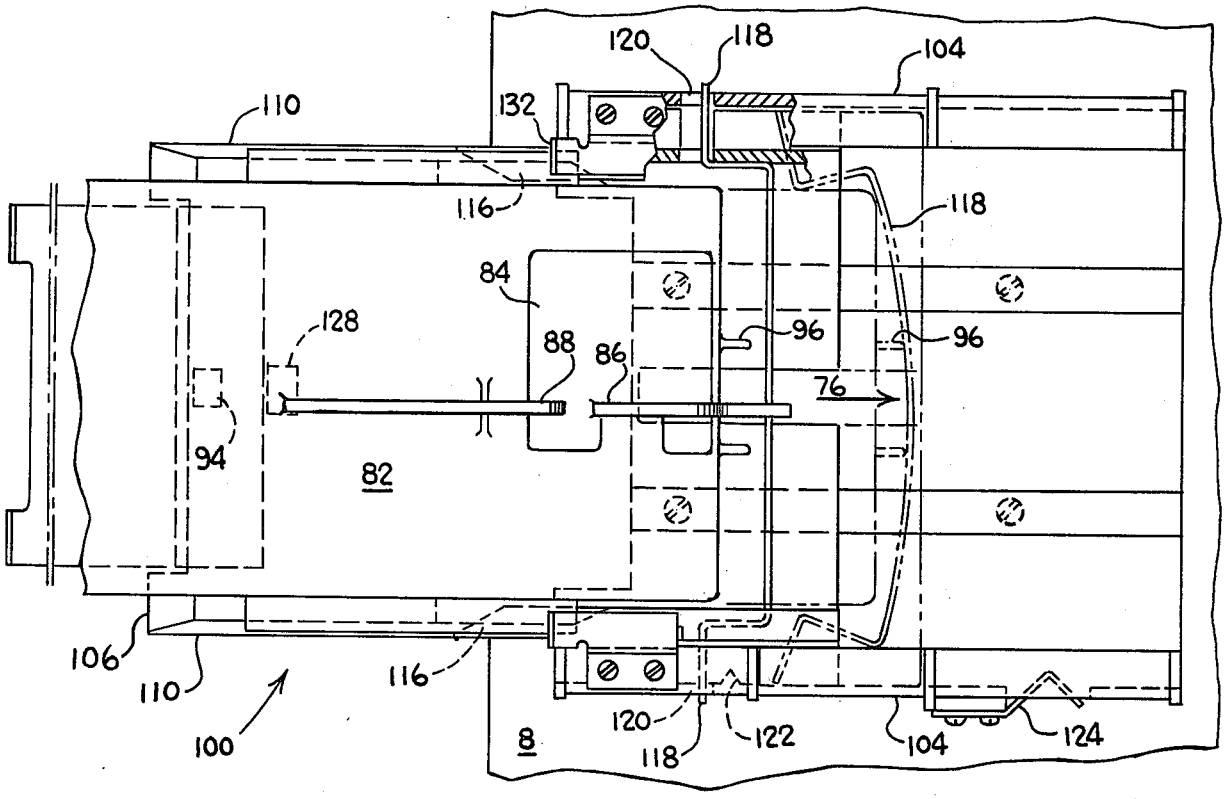
FIG. 7 is a plan view of the liquid container and tray of the liquid reservoir assembly according to this invention with the tray in the process of being inserted in the system.

Located on each of two opposite sides of the container 82 as seen in FIGS. 1, 4 and 7 are an upper horizontal flange retaining guide means 90 and a lower horizontal flange retaining guide means 92. These retaining guide means engage complementary means on a guide assembly to maintain the container 82 in firm position when installed in the postage meter mailing machine, as will be explained hereinafter. The container 82 also has extending from its bottom surface a lip or tab 94 which fits into a hole in a container support tray to removably secure the container therein. The guide assembly, indicated generally at 100, includes a fixed member 102 secured to the bottom frame member 8 by means of machine screws 9. The fixed member 102 has two identical side channel members, both represented by the numeral 104, which slidingly receive a movable carrier tray member 106. The movable tray member 106 comprises a base 108 and depending parallel ribs 109 each having a slot 112 which engages a pin 114 positioned in each bottom channel 107 of the fixed member 102 to limit the amount of travel as the movable tray member 106 slides within the fixed member 102.

The tray base 108 is sized to receive the container 82 in close fitting relationship and includes a U-shaped channel or track member 116 which receives the horizontal lower flange 92 of the container 82 in sliding engagement. The vertical side members 110 of the tray 106 carry at their forward end a column spring 118 extending across the upper forward surface of the base 108. When the movable tray 106 is withdrawn to an open position from the fixed member 102, and with the container 82 removed, the ends of the column spring 118 extend into openings 120 in the fixed side channel members 104 and maintain the tray 106 in the open position. When the container 82 is replaced on the tray 106, the spring 118 is contacted by ribs 96 protruding from the container so that the spring 118 is flexed and the ends thereof withdraw from the openings 120 thereby permitting the movable tray 106 to slide in the fixed member 102 (see FIGS. 7 and 8).

The side members 110 of the movable tray 106 also contain notches, shown at 122, for receiving bent tension spring 124 in detent engagement when the movable carrier tray 106 slides within the fixed member 102 to a closed position and thus may be there removably secured. The tray base 108 also carries, as an extension, a retainer 126 to further require the container 82 to be removed in an initial vertical motion. Located in the tray base 108 is an opening 128 which receives the tab 94 of the container 82 when it is secured therein.

The fixed member 102 includes opposite vertically upstanding members 130 each having a horizontal flange 132 projecting inwardly therefrom. The horizontal flange 132 rides on the flange 90 of the container 82 in rail-like fashion to secure the container 82 downward on the movable tray 106 when it is slidably inserted within the fixed member 102 in closed operative position.

The operation of the liquid reservoir assembly is illustrated in FIGS. 4, 5, 7 and 8. Referring first to FIG. 4 there is shown the insertion of the container 82 onto the base 108 of the movable tray 106 so taht the container lower flange means 92 is engaged within the channels 116 of the carrier tray 106. The container 82 must be placed within the tray 106 by first tilting it to the horizontal to clear the retainer 126 and to insert the lower forward flange means 92 in the channels 116. When the container is fully positioned in the base 108 it flexes the column spring 118 and the tab 94 on the container bottom projects into the opening 128 of the base 108. The tab 94 is maintained tightly in position as a consequence of the backward force exerted on the container 82 by the column spring 118. At the same time that the container 82 contacts the column spring 118 and flexes it, the spring ends are released from the openings 120 in the side channel members 104 of the fixed member 102 permitting the tray 106 to slide inward in the direction indicated by the arrow 76 in FIG. 4.

Figure 8:
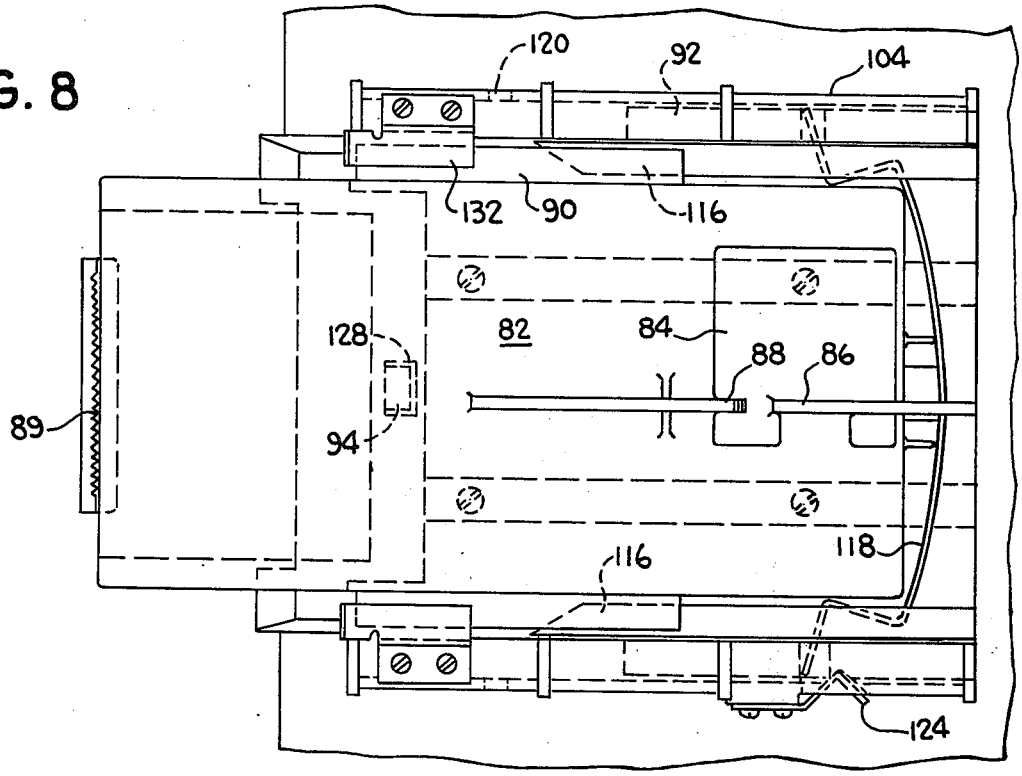
FIG. 8 is a plan view similar to that of FIG. 7 with the container and tray in operative position within the system.

As the container 82 slides inward into the machine on the movable tray member 106, the cam follower 25 engages the cam surface 88 pivoting the support plate 16 about the pivot bolt 44 causing the endless belt 14 to project downward into the container as shown in FIG. 2. Referring again to FIG. 2, once the container 82 and the tray 106 are slid within the machine the flange track 132 engages the upper horizontal flange 90 of the container 92 to maintain the container securely therein to avoid any upward movement whatsoever. Also in this position, the spring 124 engages the notch 122 in the side member 110 of the tray 106 and maintains it in a position in which it can be removed only by applying slight pressure. The manner in which the column spring is bent to release it from openings 120 is illustrated in FIG. 7 where it is shown in two positions, one in phantom, as it is progressed in the direction of the arrow 76 sliding into the machine. FIG. 8 shows the container and tray in their operative position within the machine, as in FIG. 2.

To remove the container, it is gradually withdrawn in the direction shown by the arrow 74 in FIG. 5. This slides the movable tray member 106 while, at the same time, the cam follower pin 25 engages the cam surface 86 to pivot the support 16 about the pivot bolt 44 and move the endless belt 14 up out of the container 82. The movable tray member 106 is opened to a position in which the container 82 can be removed from the base 108. At this point, the container must be lifted upward at its front end 89 over bumper 126 so that the catch tab 94 may be released from the opening 128. Then the container 82 may be slid out from engagement between the lower flange means 92 and the track 116. At the same time, the ends of the column spring 118 snap into the openings 120 to prevent the tray 106 from being pushed into the machine without the container in place.

Thus, the liquid reservoir assembly described and illustrated requires the user to proceed through several deliberate operations before being able to remove the liquid container for refilling and/or cleaning. This is advantageously done in order to prevent sudden removal and avoid spilling. Furthermore, operation of the moistening device without the presence of a liquid container therein is prevented. Accordingly, first the container is pulled out horizontally with the movable carrier tray to a stop position, then the container is vertically lifted slightly to release the catch tab which is held in place by the force of the column spring on the front of the container. The container is then pulled out further horizontally to a position which clears the retaining guides on the tray sides to permit the container to be lifted up and out in a partially pivoting movement about its inner lower edge.

What is claimed is:

1. A moistening system for moistening the gummed flaps of envelopes processed in an envelope handling machine such as a postage meter mailing machine comprising:

a liquid reservoir means for containing a supply of liquid;

an endless belt means capable of transferring moisture extending outward from the reservoir means;

a support means for operatively movingly carrying the endless belt means, and a contoured finger means operatively associated with the support means positioned adjacent to the endless belt means;

the contoured finger means and the endless belt means defining between them, upon insertion of an envelope flap therebetween, an area for receiving the gummed flap of an envelope;

the contoured finger means being so shaped and positioned relative to the endless belt means as to apply pressure against at least a portion of a flap inserted therebetween in such a manner that the gummed edge portion of the envelope flap contacts the endless belt means to receive moisture therefrom.

2. A moistening system as claimed in claim 1 wherein the contoured finger means is bowed relative to the endless belt means and cooperates with the endless belt means so as to selectively apply pressure against the flap in a manner to provide moistening of essentially only the gummed edge portion of the envelope flap.

3. A moistening system as claimed in claim 1 wherein the envelope handling machine includes a deck on which travel the envelopes to be processed and the endless belt support means is positioned at the edge of and below the deck so that the envelope flap gummed edge is moistened as it extends over the edge of the deck and below the deck while the envelopes main body travels on the deck upper surface.

4. A moistening system as claimed in claim 1 in which the endless belt means extends below the surface of the liquid in the reservoir means and through its movement agitates the liquid therein.

5. In an envelope processing machine having means for longitudinally moving envelopes through the machine and means for transferring moisture to the flaps of the envelopes from a liquid reservoir means, the improvement in moistening means comprising:

an endless belt means capable of transferring moisture extending into the reservoir means;

a support means for operatively movingly carrying the endless belt means, and means for urging the flap against the moisture transferring means comprising a contoured finger means bowed and positioned relative to the endless belt means in such a manner so as to urge essentially only the gummed edge portion of the envelope flap against the endless belt means.

6. The improvement as claimed in claim 5 wherein the bowed finger means is positioned so that an axis through its longitudinal center falls upstream, relative to the direction of envelope travel, of the downstream edge of the endless belt means, the bowed finger extends partially above a deck on which the main body of the envelope travels as the flap travels over the edge of the deck, the upper upstream edge portion of the bowed finger is so shaped as to provide guide means to guide the flap between the finger and the endless belt means for application of moisture thereto, and the bowed finger possesses a curved twist, about its longitudinal axis, relative to a plane through its axis and essentially parallel to the moistening surface of the endless belt means.

7. The improvement as claimed in claim 5 wherein:

the endless belt support means is positioned at the edge of and below a deck on which the main body of the envelope travels as the flap travels over the edge of the deck.

8. A system for moistening the gummed flaps of envelopes being processed in a postage meter mailing machine having a deck on which the main body of the envelope travels as the flap travels over the edge of the deck comprising:

an endless belt support means mounted below the deck;

the endless belt support means including endless belt support rollers and at least one drive pulley for rotating an endless belt;

and endless belt capable of picking up and transferring moisture mounted on the support means;

the endless belt support means being mounted so that the endless belt thereon presents a moisture transferring planar surface positioned substantially parallel to a flap traveling over the edge of the deck;

a liquid container positioned with respect to the support means so that the endless belt is capable of extending into the container to pick up liquid therefrom; and means for urging the gummed flap of an envelope against the surface of the endless belt to receive moisture therefrom.

9. A system for moistening the gummed flaps of envelopes as claimed in claim 8 wherein the means for urging the gummed flap of an envelope against the surface of the endless belt comprises a spring tensioned curved finger means positioned adjacent to the moisture applying surface of the endless belt and bowed and twist contoured relative to the endless belt surface so as to urge essentially only the gummed region of the flap against the endless belt for moisture transfer thus avoiding wetting of the entire flap.

* * * * *